US009581327B2

(12) United States Patent
Bairley et al.

(10) Patent No.: US 9,581,327 B2
(45) Date of Patent: Feb. 28, 2017

(54) CONTINUOUS STEAM GENERATOR WITH EQUALIZING CHAMBER

(75) Inventors: Donald W. Bairley, Farmington, CT (US); Wesley P. Bauver, II, Granville, MA (US); Thomas P. Mastronarde, West Hartford, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 898 days.

(21) Appl. No.: 12/411,616

(22) Filed: Mar. 26, 2009

(65) Prior Publication Data

US 2009/0241859 A1 Oct. 1, 2009

Related U.S. Application Data

(60) Provisional application No. 61/039,965, filed on Mar. 27, 2008.

(51) Int. Cl.

| | |
|---|---|
| ***F22B 29/06*** | (2006.01) |
| ***F22B 37/22*** | (2006.01) |
| ***F22B 21/04*** | (2006.01) |

(52) U.S. Cl.

CPC ..... *F22B 37/227* (2013.01); *F22B 21/04* (2013.01)

(58) Field of Classification Search

CPC ..... F22B 37/227; F22B 21/04; F22B 21/12; F22B 21/14; F22B 21/18

(Continued)

(56) References Cited

U.S. PATENT DOCUMENTS 1,772,972 A * 8/1930 Volcker ..... 122/235.11
1,839,074 A 12/1931 Yarrow (Continued)

FOREIGN PATENT DOCUMENTS

| | | |
|---|---|---|
| BE | 558686 | 7/1957 |
| CH | 145235 | 2/1931 |

(Continued)

OTHER PUBLICATIONS

PCT International Search Report and the Written Opinion of the International Searching Authority dated Mar. 24, 2010—(PCT/US2009/038383).

(Continued)

*Primary Examiner* — Steven B McAllister
*Assistant Examiner* — Ko-Wei Lin
(74) *Attorney, Agent, or Firm* — GE Global Patent Operation; Stephen G. Midgley

(57) ABSTRACT

An evaporator 10 for evaporating a liquid includes a plurality of harps 20 disposed within a duct or chamber such that a heated fluid flow 22 (e.g., heated gas or flue gas) passes through each successive row of harps 20 of the evaporator 10. Each of the harps 20 includes a lower header 24, a plurality of lower tubes 26, an intermediate equalizing chamber 28, a plurality of upper tubes 30, and an upper header 32. The lower tubes 30 are in fluid communication with the lower header 24 and extend upward vertically from the lower header. The upper ends of the lower tubes 26 are in fluid communication with the equalizing chamber 28. The upper tubes 30 are in fluid communication with the equalizing chamber 28 and extend upward vertically from the equalizing chamber. The upper ends of the upper tubes 30 are in fluid communication with the upper header 32.

20 Claims, 7 Drawing Sheets

(58) Field of Classification Search
USPC ..... 122/1 B, 1 C, 406.1, 406.4, 235.11, 332, 122/409
See application file for complete search history.

(56) References Cited

U.S. PATENT DOCUMENTS

| | | | | |
|---|---|---|---|---|
| 1,915,436 | A | 6/1933 | Jackson | |
| 1,915,463 | A | 6/1933 | Jackson | |
| 3,185,136 | A * | 5/1965 | Cozza | 122/406.4 |
| 5,568,793 | A * | 10/1996 | Ziegler | 122/460 |
| 6,173,679 | B1 * | 1/2001 | Bruckner et al. | 122/406.4 |
| 6,189,491 | B1 * | 2/2001 | Wittchow et al. | 122/1 C |
| 6,371,058 | B1 * | 4/2002 | Tung | 122/488 |
| 6,675,747 | B1 * | 1/2004 | Goidich et al. | 122/406.4 |
| 6,957,630 | B1 * | 10/2005 | Mastronarde | 122/406.4 |
| 7,281,499 | B2 * | 10/2007 | Franke et al. | 122/406.5 |
| 7,533,632 | B2 * | 5/2009 | Stone et al. | 122/235.12 |
| 7,587,133 | B2 * | 9/2009 | Franke et al. | 392/386 |
| 7,878,157 | B2 * | 2/2011 | Effert et al. | 122/6 A |
| 2006/0075977 | A1 | 4/2006 | Franke et al. | |
| 2007/0084418 | A1 * | 4/2007 | Gurevich | 122/1 B |

FOREIGN PATENT DOCUMENTS

| | | | | |
|---|---|---|---|---|
| DE | 425171 | | 2/1926 | |
| DE | 426488 | | 3/1926 | |
| GB | 279178 | | * 10/1926 | F22B 37/26 |
| GB | 279178 | | 10/1927 | |
| RU | 2310121 | C2 | 11/2007 | |
| SU | 178919 | A | 3/1966 | |
| SU | 840553 | A1 | 6/1981 | |

OTHER PUBLICATIONS

Australia Office Action issued in connection with corresponding AU Application No. 2009249510 on Aug. 24, 2011.

Australian Notice of Allowance Office Action issued in connection with corresponding AU Application No. 2009249510 on Jul. 6, 2012.

Unofficial English translation of VietNam Office Action issued in connection with corresponding VN Application No. 1-2010-02792 on Oct. 31, 2012.

Russian Notice of Allowance Office Action issued in connection with corresponding RU Application No. 2010143862 on Oct. 24, 2014.

* cited by examiner

CONTINUOUS STEAM GENERATOR WITH EQUALIZING CHAMBER

CROSS-REFERENCE TO RELATED APPLICATIONS

The present invention claims the benefit of U.S. Provisional Patent Application Ser. No. 61/039,965, entitled "CONTINUOUS STEAM GENERATOR WITH EQUALIZING CHAMBER", which is incorporated herein by reference.

TECHNICAL FIELD

The present invention relates generally to once-through evaporators used on large heat recovery steam generators (HRSGs), and, more particularly, to a once-through evaporator used on a large HRSG having an equalizing chamber.

BACKGROUND

Current once-through evaporator technology may be employed with large HRSGs to provide two stages of heat exchange. The first stage produces steam/water mixture. The second stage evaporates the water to dryness and superheats the steam. In general, each stage of the HRSG includes a parallel array of heat transfer tubes where internal mass flow rate is controlled by buoyancy forces, and is proportional to the heat input to each individual tube. One type of evaporator uses vertical tubes arranged in a sequential array of individual tube bundles, where each tube bundle (or harp) has a row of tubes that are transverse to the flow of the hot gas. The individual harps are arranged in the direction of gas flow, so that each downstream harp absorbs heat from gas of a lower temperature than the harp immediately upstream. In this way, the heat absorbed by each harp in the direction of gas flow is less than the heat absorbed by the upstream harp. This type of evaporator is similar to that disclosed in U.S. Pat. No. 6,189,491 entitled "Steam Generator", filed on Jun. 14, 1999, which is incorporated herein by reference.

HRSGs using this principle require the distribution of a water/steam mixture (two-phase flow) from the outlet of a primary evaporator into a secondary evaporator, where dry-out and superheat takes place. The secondary evaporator is formed from one or more harp bundles with multiple inlets on the bottom header. Each inlet provides two-phase flow through a branch connection into the lower header. Each inlet to a header of the secondary evaporator receives two-phase flow from a mixing device downstream of the primary evaporator.

Two-phase flow from one inlet connection is distributed along the length of a portion of the header to outlet tubes in the upper portion of the header. Each outlet tube is an individual evaporator tube in the respective row of the secondary evaporator.

It is known by those skilled in the art that separation of two-phase flow can occur in the bottom header of the secondary evaporator, leading to non-uniform distribution of water/steam mixture into the secondary evaporator heat exchanger tubes within a particular tube row (or harp). For equal mass flow rates, in tubes receiving a higher steam fraction, the water/steam mixture will evaporate to dryness sooner, leading to higher degree of superheat at the exit of the individual tube. In tubes receiving a higher water fraction, the water/steam mixture will evaporate to dryness later, leading to lower degree of superheat at the exit of the individual tube. The thermal expansion of an individual evaporator tube is determined by the integral of the temperature rise of the internal fluid along the length of the tube.

The integrated average temperature of the tube with the higher superheat at the outlet will be higher that the integrated average temperature of tube with lower superheat at the outlet. When adjacent tubes in an individual harp inlet header receive different water/steam fractions, the integrated average of the tube temperature will be different for each tube. Since the tubes are constrained at the upper and lower end by being joined to a common header at both ends, differential temperature in adjacent or nearby tubes will cause a differential thermal stress to develop in the tubes. During startup and load ramps, the non-uniform flow distribution in the inlet headers of the secondary evaporator will vary in location and degree. It has been demonstrated that the location of high differential thermal stress will change during these conditions. An individual tube may transition from a state of no differential thermal stress, to a state of high stress during startup or load ramps. This change of stress has been shown to lead to an alternating stress at the tube joint at the branch connection. When the magnitude of this stress is sufficiently high, and when the number of occurrences reaches a predictable amount, the tube joint is susceptible to failure from low-cycle fatigue.

The evaporator of the present invention applies the principles of an equalizing chamber within the first and/or second stage evaporator to mitigate the effects of the two-phase flow separation at the inlet of the second stage of the evaporator, as will be described in greater detail.

SUMMARY

According to the aspects illustrated herein, there is provided an evaporator for evaporating a liquid. The evaporator includes a lower header, and a plurality of lower tubes having an upper end and a lower end. The lower ends of the lower tubes are in fluid communication with the lower header, and the upper ends of the lower tubes are in fluid communication with an intermediate chamber. A plurality of upper tubes has an upper end and a lower end. The lower ends of the upper tubes are in fluid communication with the intermediate chamber. An upper header is in fluid communication with the upper ends of the upper tubes.

BRIEF DESCRIPTION OF THE DRAWINGS

Referring now to the figures, which are exemplary embodiments, and wherein the like elements are numbered alike.

DETAILED DESCRIPTION

For convenience in the description of the present invention, the present invention is described hereafter as an evaporator used in conjunction with a boiler or within a power plant. However, one skilled in the art will appreciate that the evaporator may be used for any application requiring evaporation of a liquid or superheating of a gas.

Figure 1B:
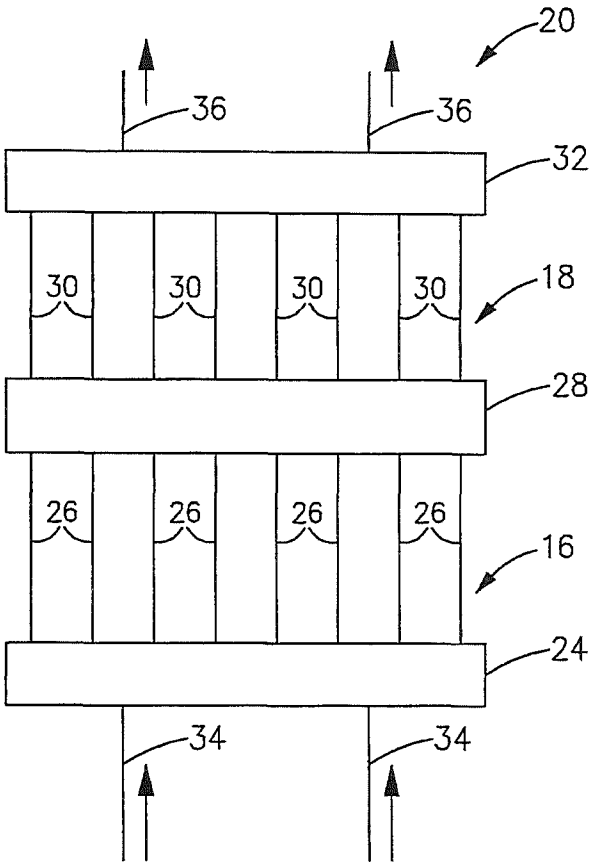
FIG. 1*b* is a front elevational view of a harp of an evaporator including a plurality of upper tubes interconnected between an upper header and an intermediate equalizing chamber and a plurality of lower tubes interconnected between the intermediate equalizing chamber and a lower header, in accordance with the present invention.
Figure 1A:
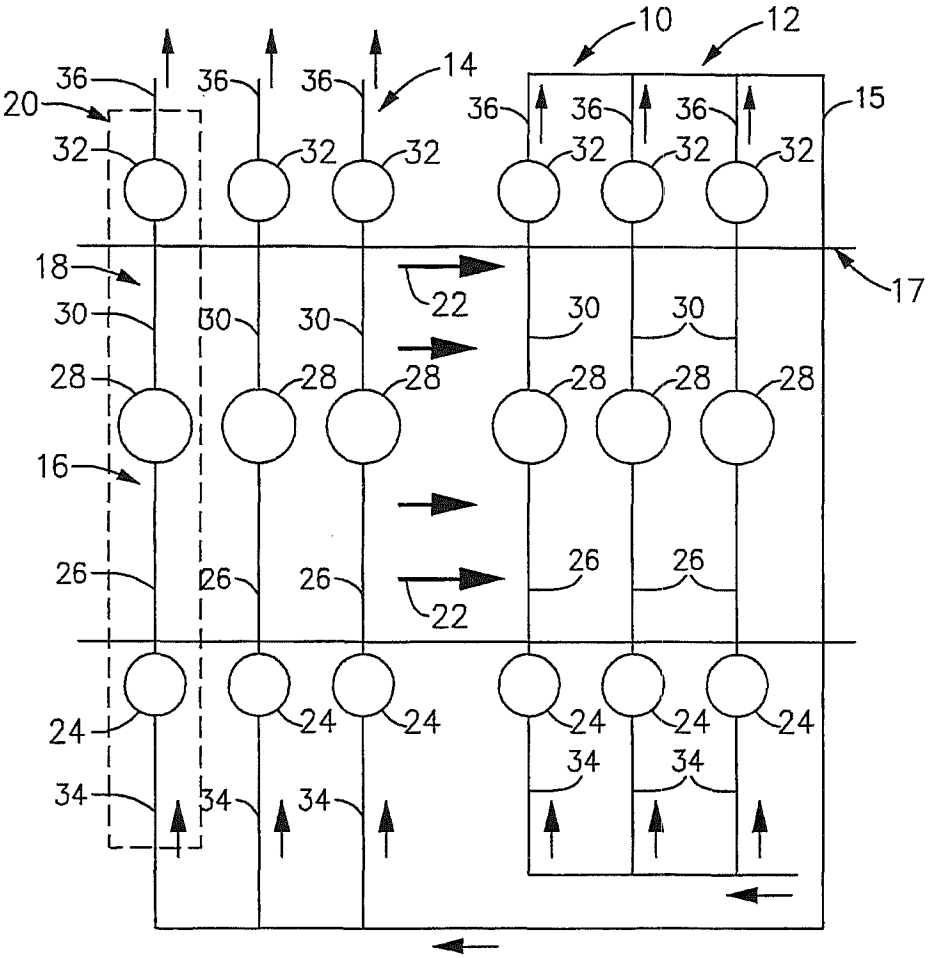
FIG. 1*a* is a side elevational view of a two-stage evaporator having a primary and secondary evaporator disposed in a duct, wherein each evaporator including a plurality of harps similar to that shown in FIG. 1*b* in accordance with the present invention.

As best shown in FIG. 1*a*, a two-stage evaporator 10 has a primary evaporator 12 for evaporating a liquid to gas e.g. water to steam, and a secondary evaporator 14 for superheating the gas or gas/liquid mixture provided by the primary evaporator. Each evaporator 12,14 includes at least one harp 20, but typically a plurality of harps, disposed within a duct or chamber 17 such that a heated fluid flow 22 (e.g., heated gas or flue gas) passes through each successive row of harps 20 of the evaporator 10. FIG. 1*b* illustrates a single harp 20 shown in FIG. 1*a*.

Referring to FIGS. 1*a* and 1*b*, each of the harps 20 includes a lower header 24, a plurality of lower tubes 26, an intermediate equalizing chamber 28, a plurality of upper tubes 30, and an upper header 32. As best shown in FIG. 1*b*, the lower tubes 26 are in fluid communication with the lower header 24 and extend upward vertically from the lower header. The upper ends of the lower tubes 26 are in fluid communication with the equalizing chamber 28. The upper tubes 30 are in fluid communication with the equalizing chamber 28 and extend upward vertically from the equalizing chamber. The upper ends of the upper tubes 30 are in fluid communication with the upper header 32. An input pipe(s) 15 provides liquid and/or steam from the upper header 32 of the primary evaporator 12 to the lower header 24 of the secondary evaporator 14. The steam and/or liquid exits the upper header 32 through a plurality of output pipes 36 of each evaporator 12,14. As best shown in FIG. 1*b*, the lower tubes 26 of each harp 20 are vertically aligned with respective upper tubes 30.

As best shown in FIG. 1*a*, the equalizing chamber 28 is disposed intermediate the lower header 24 and the upper header 32 to provide a lower primary stage 16 and an upper secondary stage 18 of the each harp 20. The lower primary stage 16 comprises the lower tubes 26 of a harp 20, which is also referred to as the lower two-phase section of the tube of a harp. Also, the upper secondary stage 18 comprises the upper tubes 30 of a harp, which is also referred to as the upper section of the tube of a harp. While the equalizing chamber is shown approximately equidistance between the upper and lower headers 32, 24, one will appreciate that the equalizing chamber 28 may be disposed at any location between the headers. The location of the equalizing chamber may be dependent on the expected amount or level of two-phase liquid in the pipe. For instance, the equalizing chamber may be disposed at or above the expected level of the two-phase fluid level in the harp 20.

The present invention introduces the equalizing chamber 28 at an optimum location in the vertical tubes 26,30 of the primary and/or secondary evaporator 12,14 to reduce the differential temperature in adjacent tubes of a respective harp 20. This favorable effect may be achieved in both the lower two-phase section of the evaporator tube (i.e., the lower primary stage 16) or the upper section (i.e., the upper secondary stage 18). The equalizing chamber 28 may be a cylindrical chamber with cross sectional area large compared to one tube cross sectional area to facilitate mixing of flows from the individual tubes.

In the operation of the two-stage evaporator 10, a liquid (e.g., water) is provided to the input pipes 34 of the primary evaporator 12. The water is provided to the tubes of the lower primary stage 16 via the input header 24. The water is then heated to form a water/steam mixture therein, which is provided to the equalizing chamber 28 where the mixture exiting from each tube 26 mixes together. The equalizing chamber 28 of a harp blends the different steam water fractions from adjacent tubes 26 exiting from the lower primary stage 16 of the harp 20. This blending of different steam/water fractions promotes a more uniform blend quality exiting the equalizing chamber 28 to the tubes 30 of the upper secondary stage 18 of the harp 20. In the upper secondary stage 18 of the harp 20, mixing of flow streams with different steam temperatures in the intermediate equalizing chamber 28 will promote more uniform temperature entering the tubes 30 of the upper secondary stage 18 of the harp. Consequently, the heated or superheated gas entering the upper header 32 of the harp 20 is more uniform in temperature.

The advantages of the equalizing chamber 28 in the primary evaporator 12 of the two-stage evaporator 10 are the same for providing an equalizing chamber 28 in the secondary evaporator 14. Ultimately, the addition of an equalizing chamber(s) 28 results in the temperature of the final superheated gas at the inlet to the upper headers 32 of the secondary evaporator 14 will be more uniform when an equalizing chamber 28 is introduced into the evaporator tube flow path. As a result, the differential thermal stresses will be reduced during startup and load ramps, extending the life of the evaporator tube-to-header connections.

Figure 2B:
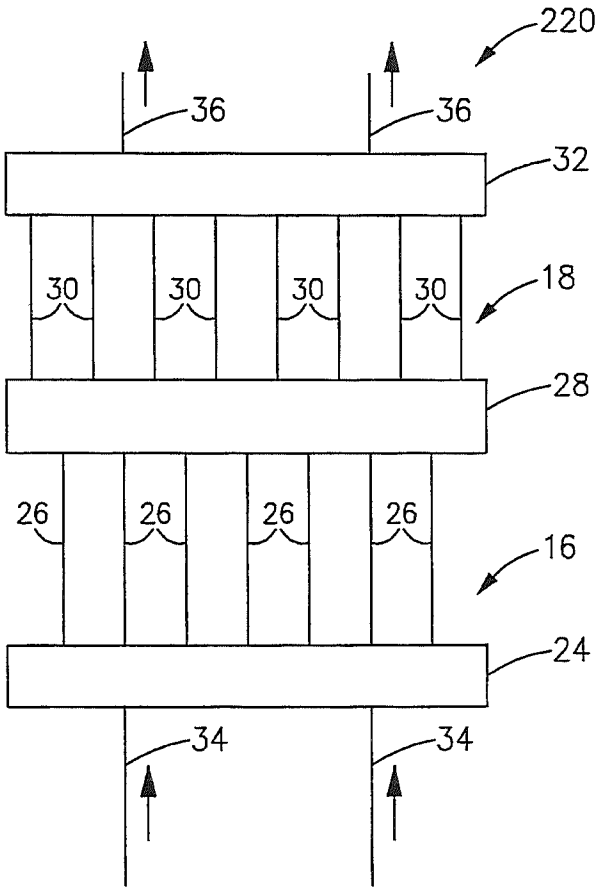
FIG. 2*b* is a front elevational view of a harp of an evaporator including a plurality of upper tubes interconnected between an upper header and an intermediate equalizing chamber and a plurality of lower tubes interconnected between the intermediate equalizing chamber and a lower header, in accordance with the present invention.
Figure 2A:
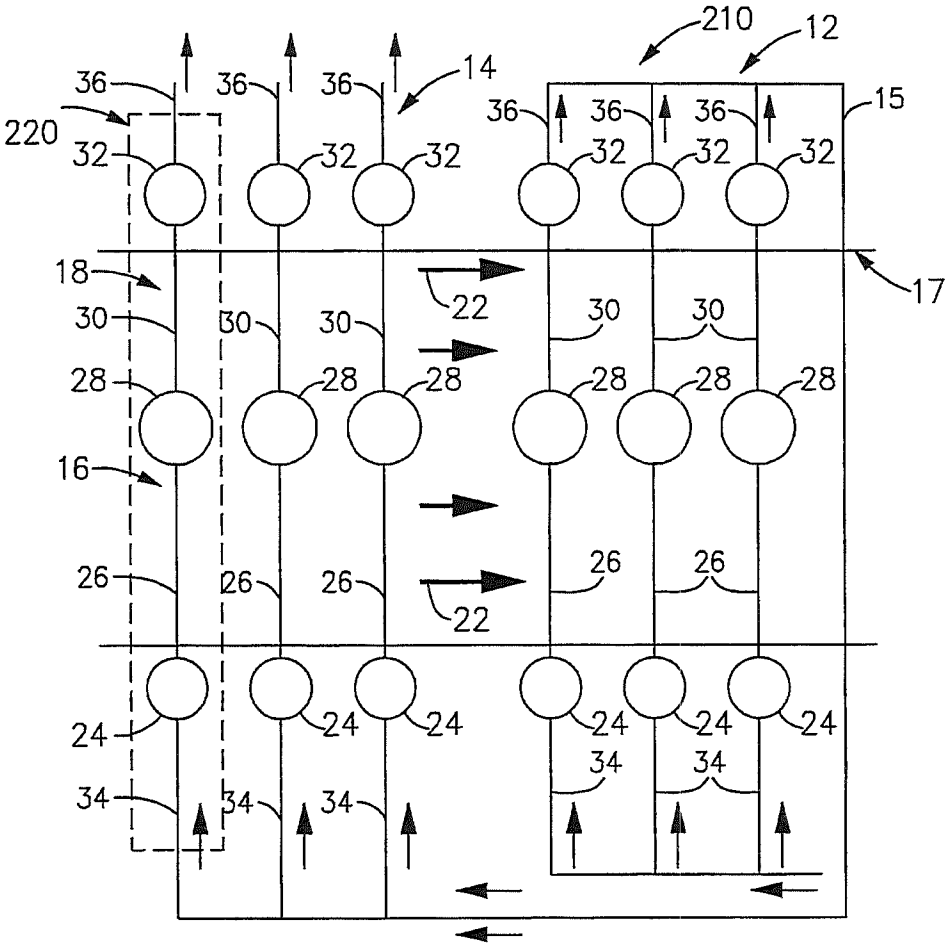
FIG. 2*a* is a side elevational view of another embodiment of a two-stage evaporator having a primary and secondary evaporator disposed in a duct, wherein each evaporator including a plurality of harps similar to that shown in FIG. 2*b* in accordance with the present invention.

FIGS. 2*a* and 2*b* illustrate another embodiment of a two-stage evaporator 210 in accordance with the present invention. Components of different embodiments having the same reference numeral are the same as described previously. Referring to FIG. 2*a*, the two-stage evaporator 210 is similar to the two-stage evaporator 10 of FIG. 1*a*, which includes a primary evaporator 12 and secondary evaporator 14. FIG. 2*b* illustrates a harp 220 of an evaporator 12, 14, wherein the harps 220 are similar to the harps 20 of the evaporator 10 of FIGS. 1*a* and 1*b* except the lower tubes 26 and upper tubes 30 are offset vertically (not aligned). This misalignment of the lower and upper tubes promotes mixing of the fluid and steam in the equalizing chamber 28 before passing through the upper tubes 30.

Figure 3B:
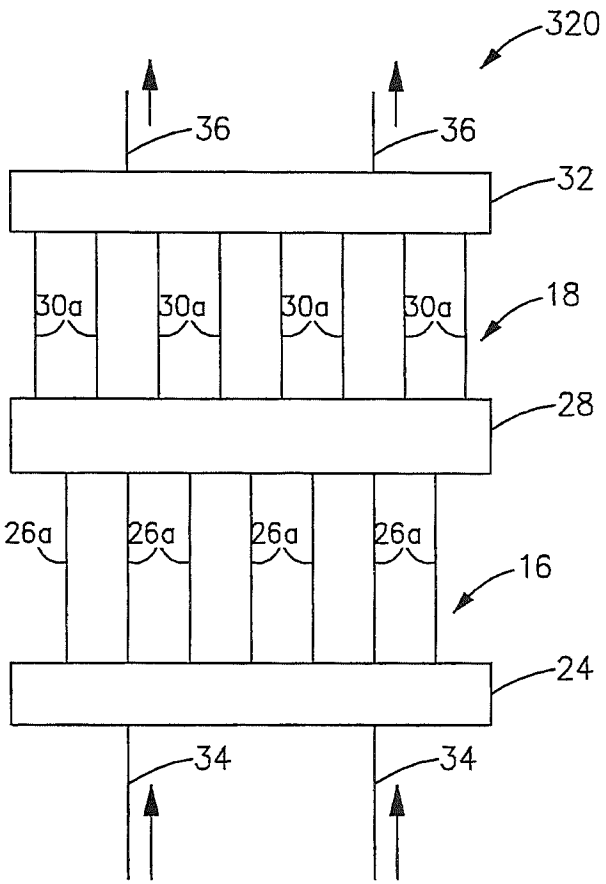
FIG. 3*b* is a front elevational view of a harp of an evaporator including a plurality of upper tubes interconnected between an upper header and an intermediate equalizing chamber and a plurality of lower tubes interconnected between the intermediate equalizing chamber and a lower header, in accordance with the present invention.
Figure 3A:
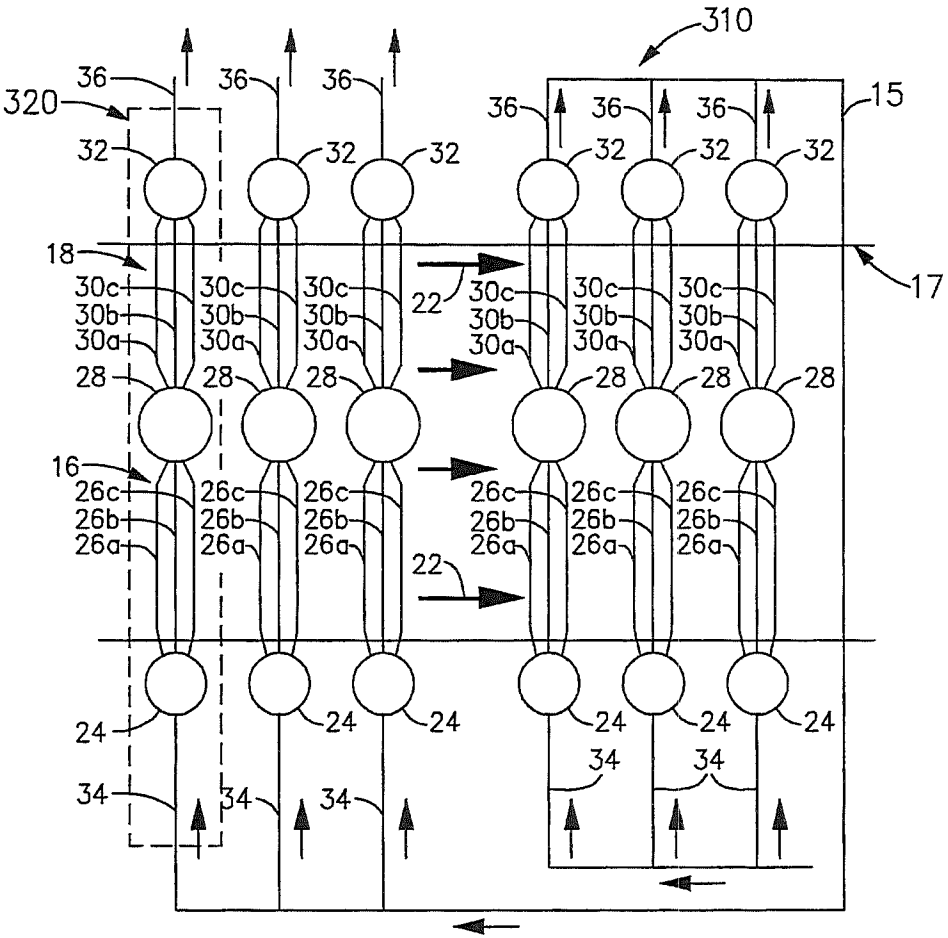
FIG. 3*a* is a side elevational view of another embodiment of a two-stage evaporator having a primary and secondary evaporator disposed in a duct, wherein each evaporator including a plurality of harps similar to that shown in FIG. 3*b* in accordance with the present invention.

FIGS. 3*a* and 3*b* illustrate another embodiment of an evaporator 310 in accordance with the present invention. As best shown in FIG. 3*a*, the evaporator 310 having a plurality of harps 320 is similar to the evaporator 210 of FIGS. 2*a* and 2*b*, except each lower tube and each upper tube of FIG. 2*b* is substituted by a plurality of respective lower tube 26*a*, 26*b*, 26*c* and upper tubes 30*a*, 30*b*, 30*c* (e.g., three (3) tubes), wherein the respective upper and lower tubes 26,30 are aligned in the direction of the heated gas flow 22. While the each row of tubes is shown having three tubes, one will appreciate that two (2) or more tubes may be used. Further while the upper and lower tubes are shown to be aligned in the direction of the fluid flow 22, the present invention contemplates that the upper and lower tubes may be offset horizontally from each other on a given harp 220, such that the tubes upstream do not block the tubes downstream from the fluid flow. This offset arrangement has the advantage of increased heat transfer.

Figure 4A:
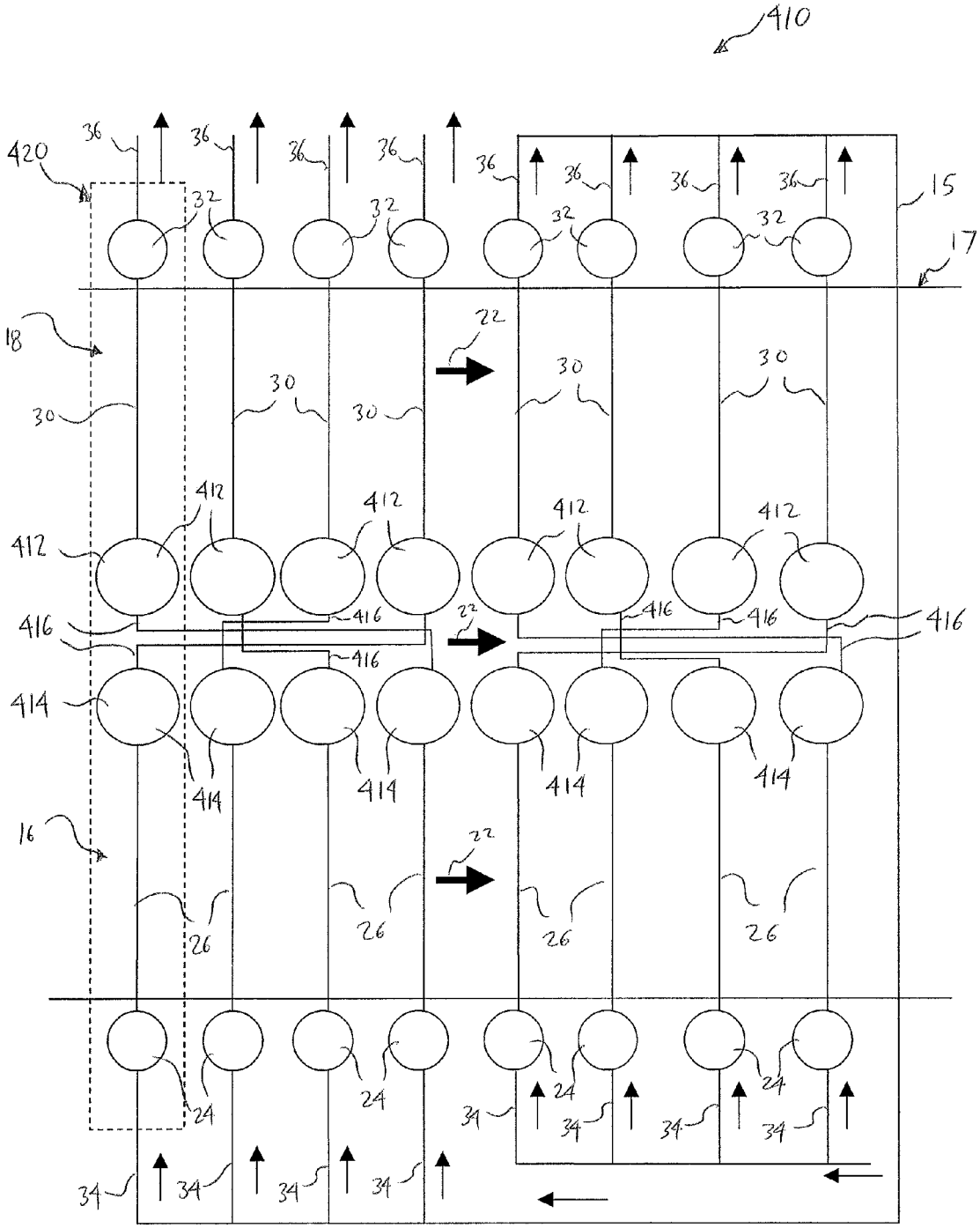
FIG. 4*a* is a side elevational view of another embodiment of a two-stage evaporator having a primary and secondary evaporator disposed in a duct, wherein each evaporator including a plurality of harps similar to that shown in FIG. 4*b* in accordance with the present invention.
Figure 4B:
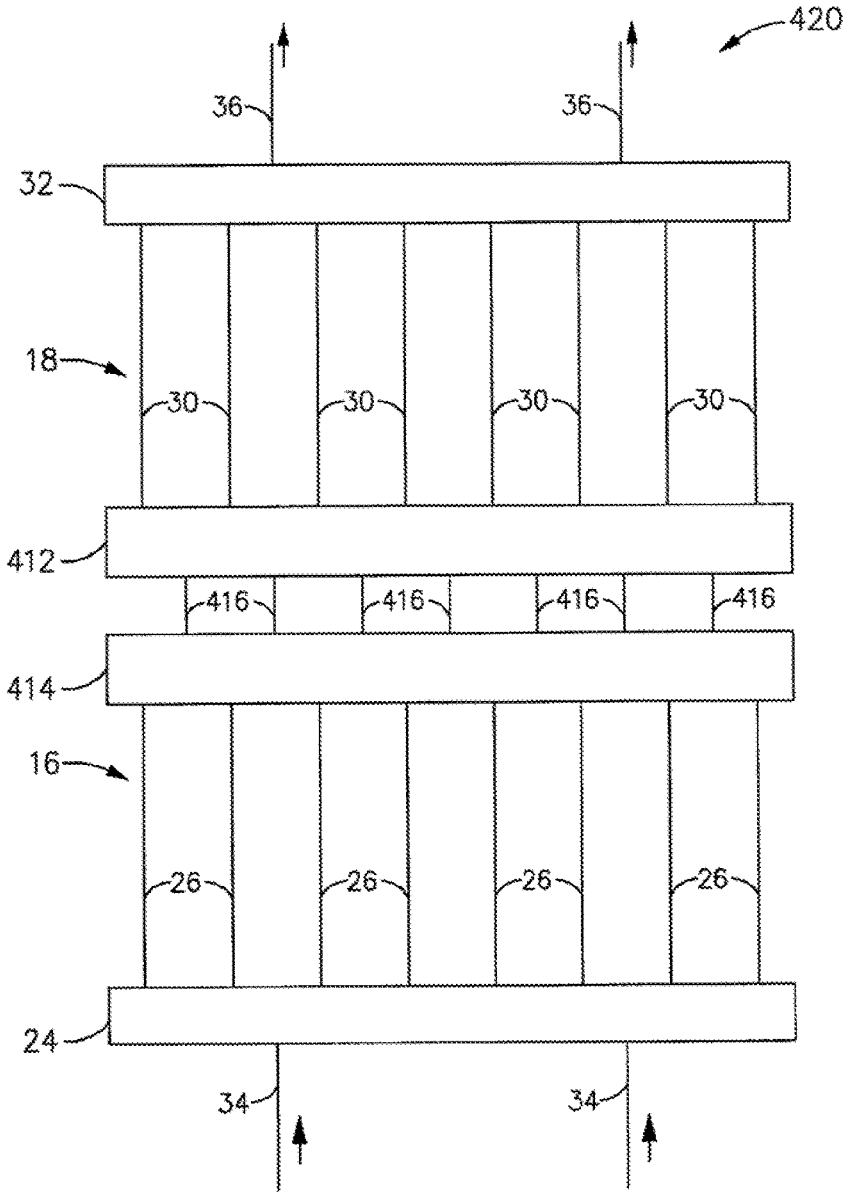
FIG. 4*b* is a front elevational view of a harp of an evaporator including a plurality of upper tubes interconnected between an upper header and an upper intermediate equalizing chamber and a plurality of lower tubes interconnected between a lower intermediate equalizing chamber and a lower header, wherein the upper and lower equalizing chambers are interconnected by intermediate tubes, in accordance with the present invention.

FIGS. 4*a* and 4*b* illustrate another embodiment of an evaporator 410 in accordance with the present invention. The evaporator 410 has a plurality of harps 420 similar to the evaporator 210 as shown in FIGS. 2*a* and 2*b*, except the intermediate equalizing chamber 28 of FIG. 2*b* is substituted for an upper equalizing chamber 412 and a lower equalizing chamber 414. Further, the lower equalizing chamber 414 and the upper equalizing chamber 412 are in fluid communication by a plurality of intermediate tubes 416, wherein the intermediate tubes interconnect the upper and lower equalizing chambers 412, 414 that are disposed in a different vertical plane. For instance referring to FIG. 4*a*, the forward lower equalizing chamber is interconnected to the rear upper equalizing chamber by a plurality of the intermediate tubes 416, while the forward upper equalizing chamber is interconnected to the rear lower equalizing chamber by a different plurality of intermediate tubes 416. This promotes uniform temperature through not only a single harp but also through a plurality of harps. While a particular arrangement of interconnection between upper and lower equalizing chambers 412,414 by intermediate tubes 416 is shown, one will appreciate that the interconnection may be in any configuration.

Figure 5A:
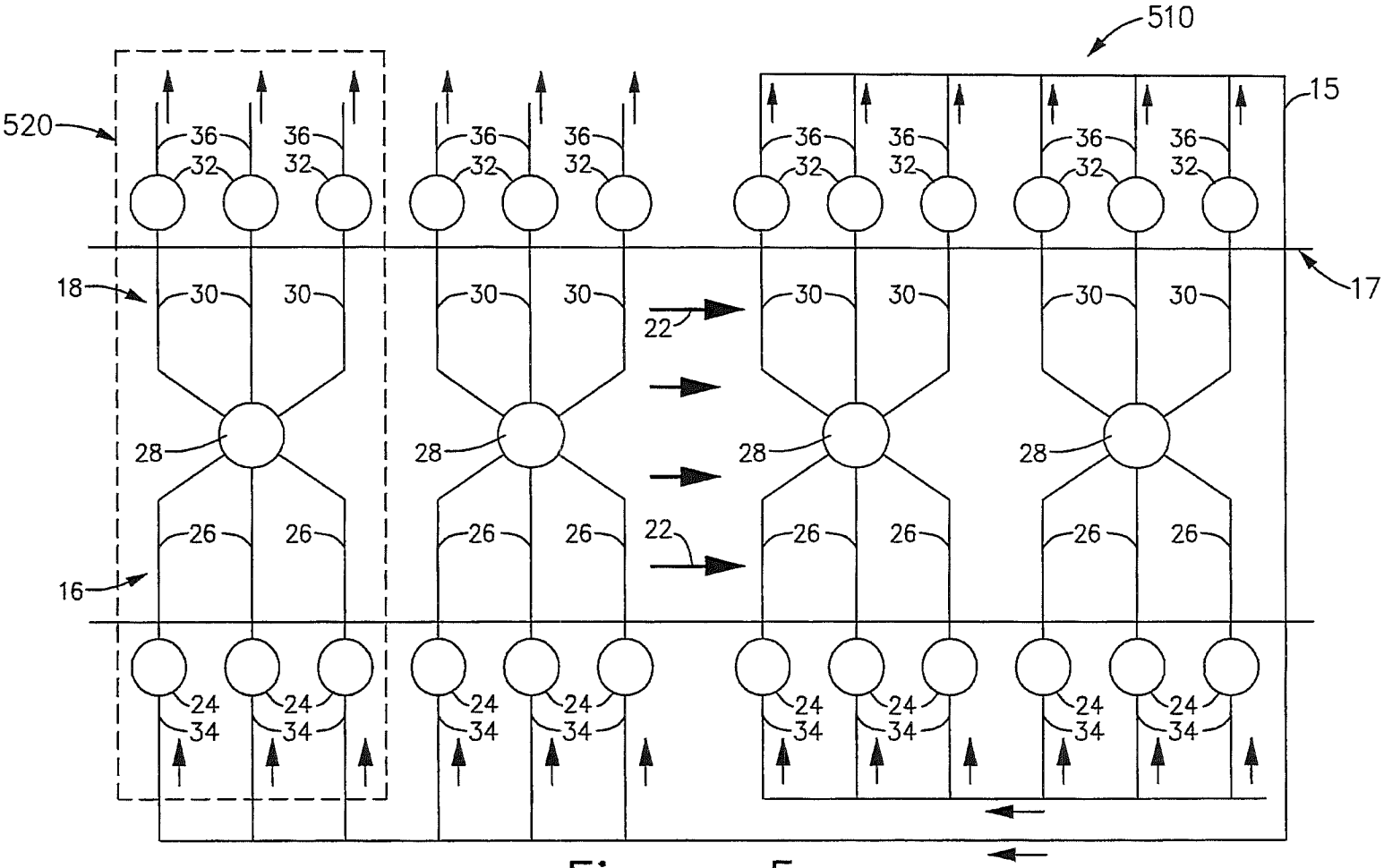
FIG. 5*a* is a side elevational view of another embodiment of a two-stage evaporator having a primary and secondary evaporator disposed in a duct, wherein each evaporator including a plurality of harps similar to that shown in FIG. 5*b* in accordance with the present invention.
Figure 5B:
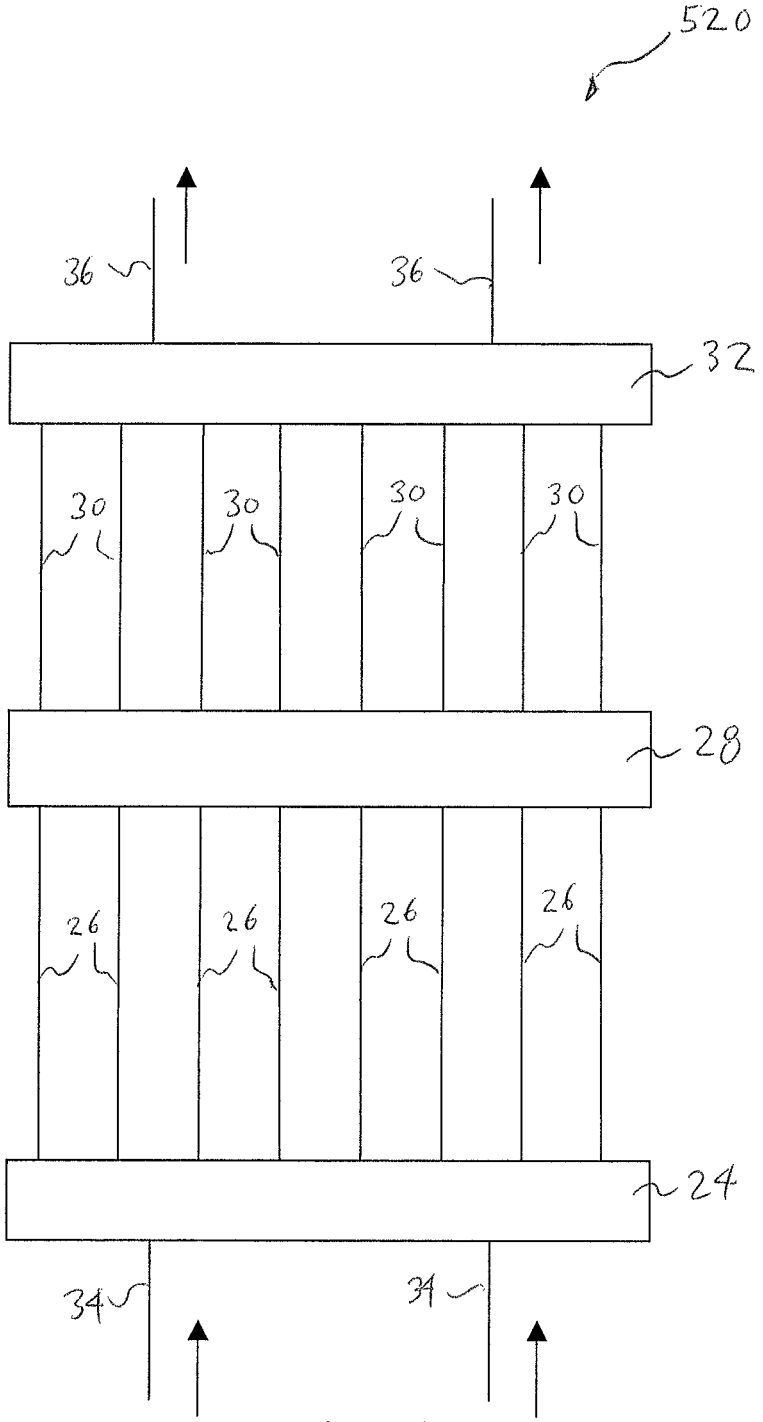
FIG. 5*b* is a front elevational view of a harp of an evaporator including a plurality of upper tubes interconnected between an upper header and an intermediate equalizing chamber and a plurality of lower tubes interconnected between the intermediate equalizing chamber and a lower header, in accordance with the present invention.

FIGS. 5*a* and 5*b* illustrate another embodiment of an evaporator 510 in accordance with the present invention. The evaporator 510 is similar to the evaporator 10 of FIGS. 1*a* and 1*b*, except the plurality of equalizing chambers 28 of FIG. 1*a* are replaced with a single equalizing chamber 28, whereby a single equalizing chamber functions for a plurality of upper and lower tubes 30, 26. While three sets of upper and lower tubes are shown interconnected to a single equalizing chamber 28, any number (e.g., two (2) or more) of harps 520 may be interconnected to the equalizing chamber. This promotes uniform temperature through not only a single harp but also through a plurality of harps.

While in each of the embodiments the headers are shown disposed external to the duct, the present invention contemplates that the the upper and/or lower headers may be disposed within the duct.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An evaporator for evaporating a liquid in a heat recovery steam generator, the evaporator comprising:

a duct having a heated fluid flow passing therethrough in a flow direction, and a harp having a portion disposed transversely in the duct, the harp including:

a lower header with a liquid input pipe;

plurality of lower tubes, each having an upper end and a lower end, the lower ends of the lower tubes being fluidly connected to the lower header;

an intermediate chamber fluidly connected to the upper ends of the lower tubes, plurality of upper tubes having an upper end and a lower end, the lower ends of the upper tubes being fluidly connected to the intermediate chamber; and an upper header fluidly connected to the upper ends of the upper tubes;

wherein the plurality of upper tubes, the plurality of lower tubes and the intermediate chamber are disposed in the duct transversely to the flow direction of the heated fluid flow, and wherein the flow direction of the heated fluid below the intermediate chamber is in the same direction as the flow direction of the heated fluid above the intermediate chamber; and wherein the plurality of upper tubes and the respective plurality of lower tubes are vertically offset for promoting mixing of the fluid and steam in the intermediate chamber before passing through the plurality of upper tubes.

2. The evaporator of claim 1, wherein the lower tubes are substantially vertically disposed between the lower header and the intermediate chamber.

3. The evaporator of claim 1, wherein the upper tubes are substantially vertically disposed between the intermediate chamber and the upper header.

4. The evaporator of claim 1, wherein each upper and/or lower tube includes a set of tubes, wherein the tubes of each respective set of tubes are sequentially disposed in a respective plane downstream of and transverse to the heated fluid flow.

5. The evaporator of claim 4, wherein the tubes in sequential arrangement are aligned and/or staggered in the direction of the heated fluid flow.

6. The evaporator of claim 1, wherein the intermediate chamber receives a plurality of upper tubes and lower tubes sequentially disposed in a respective plane downstream of and transverse to the heated fluid flow.

7. An evaporator for evaporating a liquid in a heat recovery steam generator, the evaporator comprising:

a duct having a heated fluid flow passing therethrough in a flow direction, and a plurality of harps disposed sequentially in the duct in the flow direction, wherein a portion of each harp is disposed transversely in the duct, each harp including:

a lower header with a liquid input pipe;

a plurality of lower tubes, each having an upper end and a lower end, the lower ends of the lower tubes being fluidly connected to the lower header;

an intermediate chamber fluidly connected to the upper ends of the lower tubes, plurality of upper tubes having an upper end and a lower end, the lower ends of the upper tubes being fluidly connected to the intermediate chamber; and an upper header fluidly connected to the upper ends of the upper tubes;

wherein the plurality of upper tubes, the plurality of lower tubes and the intermediate chamber are disposed in the duct transversely to the flow direction of the heated fluid flow, and wherein the flow direction of the heated fluid below the intermediate chamber is in the same direction as the flow direction of the heated fluid above the intermediate chamber; and wherein the upper tubes of each harp and respective lower tubes of each harp are vertically offset.

8. The evaporator of claim 7, wherein the lower tubes of each harp are substantially vertically disposed between each respective lower header and the intermediate chamber.

9. The evaporator of claim 7, wherein the upper tubes of each harp are substantially vertically disposed between each respective intermediate chamber and the upper header.

10. The evaporator of claim 7, wherein each upper and/or lower tube of each harp includes a set of tubes, wherein the tubes of each respective set of tubes are sequentially disposed in a respective plane downstream of and transverse to the heated fluid flow.

11. The evaporator of claim 10, wherein the tubes of each harp in sequential arrangement are aligned and/or staggered in relation to the direction of the heated fluid flow.

12. The evaporator of claim 7, wherein the plurality of harps are fluidly interconnected in parallel.

13. The evaporator of claim 7, wherein the plurality of harps are fluidly interconnected in series.

14. The evaporator of claim 1, wherein the lower header and the upper header are located outside of the duct.

15. The evaporator of claim 7, wherein the lower header and the upper header are located outside of the duct.

16. An evaporator for evaporating a liquid in a heat recovery steam generator, the evaporator comprising:

a duct having a heated fluid flow passing therethrough in a single flow direction, and a harp having a portion disposed transversely in the duct, the harp including:

a lower header with a liquid input pipe;

a plurality of lower tubes, each having an upper end and a lower end, the lower ends of the lower tubes being fluidly connected to the lower header;

an intermediate chamber fluidly connected to the upper ends of the lower tubes, a plurality of upper tubes having an upper end and a lower end, the lower ends of the upper tubes being fluidly connected to the intermediate chamber; and an upper header fluidly connected to the upper ends of the upper tubes;

wherein the heated fluid flow passes through the harp in a single direction, wherein the flow direction of the heated fluid below the intermediate chamber is in the same direction as the flow direction of the heated fluid above the intermediate chamber; and wherein the plurality of upper tubes and the plurality of lower tubes are vertically offset for promoting mixing of the fluid and steam in the intermediate chamber before passing through the plurality of upper tubes.

17. The evaporator of claim 1, wherein the heated fluid flow passes through the harp in a single direction.

18. The evaporator of claim 1, wherein a plane of the heated fluid flow passes through the plurality of upper tubes and the plurality of lower tubes at substantially the same time.

19. The evaporator of claim 1, wherein the heated fluid flow passes through the harp in a single and substantially horizontal direction.

20. The evaporator of claim 1, wherein the heated fluid flow passes through the harp once.

* * * * *